US009739511B2

(12) United States Patent
Buter et al.

(10) Patent No.: US 9,739,511 B2
(45) Date of Patent: Aug. 22, 2017

(54) DISPLAY CABINETS FOR FROZEN PRODUCTS

(71) Applicant: Conopco, Inc., Englewood Cliffs, NJ (US)

(72) Inventors: Rene Joachim Buter, Vlaardingen (NL); Ashvinikumar Vishnukumar Mudaliar, Rotterdam (NL); Georgios Tetradis-Mairis, Bedfordshire (GB)

(73) Assignee: CONOPCO, INC., Englewood Cliffs, NJ (US)

( * ) Notice: Subject to any disclaimer, the term of this patent is extended or adjusted under 35 U.S.C. 154(b) by 259 days.

(21) Appl. No.: 14/410,583

(22) PCT Filed: Jun. 20, 2013

(86) PCT No.: PCT/EP2013/062858
§ 371 (c)(1),
(2) Date: Dec. 23, 2014

(87) PCT Pub. No.: WO2014/001187
PCT Pub. Date: Jan. 3, 2014

(65) Prior Publication Data

US 2015/0338138 A1 Nov. 26, 2015

(30) Foreign Application Priority Data

Jun. 29, 2012 (EP) ..... 12174379

(51) Int. Cl.
*F25B 21/00* (2006.01)
*F25D 11/02* (2006.01)
(Continued)

(52) U.S. Cl.
CPC ..... *F25B 21/00* (2013.01); *F25D 11/025* (2013.01); *F25D 23/068* (2013.01);
(Continued)

(58) Field of Classification Search
CPC ..... F25B 21/00; F25B 2321/002; F25B 2321/0021; F25B 2321/0252;
(Continued)

(56) References Cited

U.S. PATENT DOCUMENTS

RE21,941 E 11/1941 Gibson
5,701,937 A * 12/1997 Bourboulou ..... A61J 3/002 141/10
(Continued)

FOREIGN PATENT DOCUMENTS

CN 101280983 10/2008
FR 2679020 1/1993
(Continued)

OTHER PUBLICATIONS

Search Report in EP12174379, dated Nov. 2, 2012, EP.
(Continued)

*Primary Examiner* — Len Tran
*Assistant Examiner* — Ana Vazquez
(74) *Attorney, Agent, or Firm* — Foley & Lardner LLP

(57) ABSTRACT

Display cabinet for frozen products including a magneto caloric unit having cold end with a primary cold heat exchanger and a hot end with a primary hot heat exchanger, and a cabinet suitable for containing frozen products. The cabinet including an inner wall limiting a volume wherein frozen products can be stored, the cabinet having a secondary heat exchanger, wherein the secondary cold heat exchanger includes an exchanger circulator for circulating a low freezing point liquid between the secondary cold heat exchanger and the primary cold heat exchanger.

6 Claims, 3 Drawing Sheets

Figure 1:
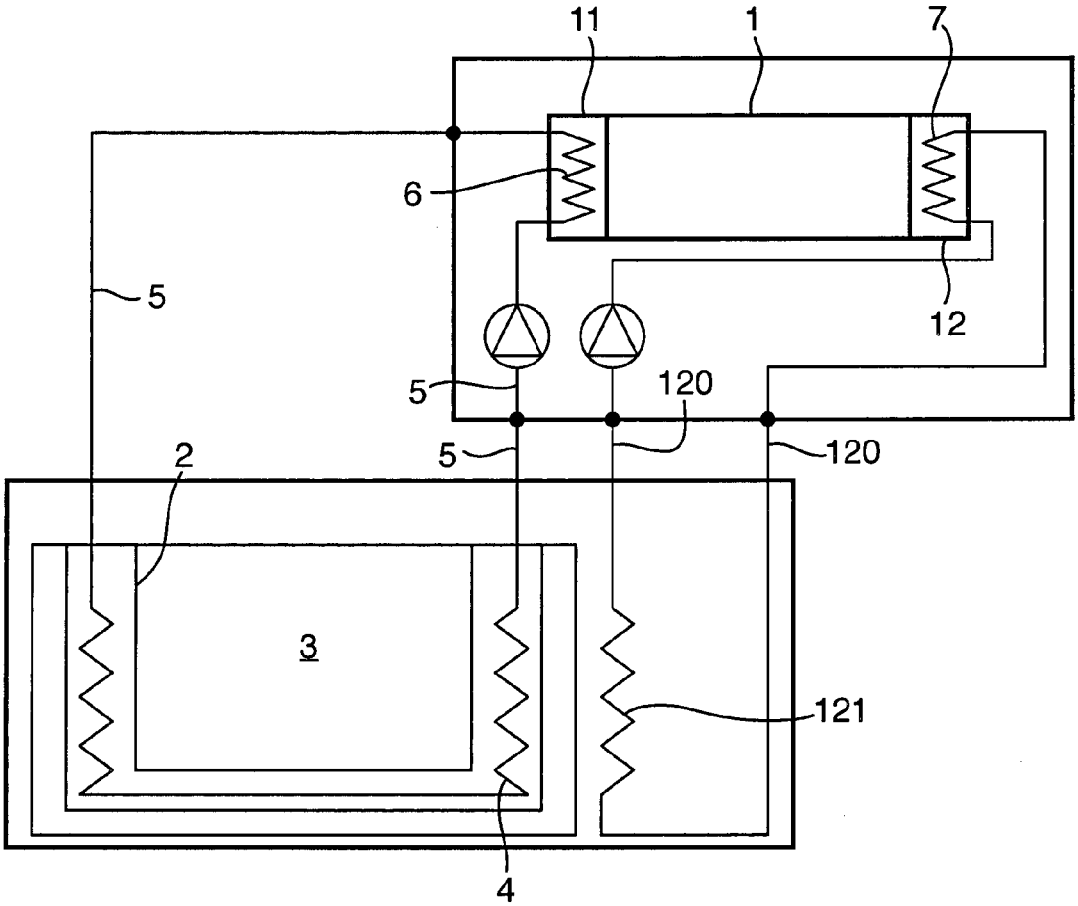

(51) Int. Cl.
*F25D 23/06* (2006.01)
*A47F 3/04* (2006.01)

(52) U.S. Cl.
CPC ..... *A47F 3/0439* (2013.01); *F25B 2321/002* (2013.01); *F25D 2400/10* (2013.01)

(58) Field of Classification Search
CPC .. F25D 11/025; F25D 23/068; F25D 2400/10; A47F 3/0439; A23C 3/04
USPC ..... 62/3.1
See application file for complete search history.

(56) References Cited

U.S. PATENT DOCUMENTS

| | | | | |
|---|---|---|---|---|
| 6,854,288 | B2 | 2/2005 | Uijen | |
| 9,631,842 | B1 * | 4/2017 | Dariavach | F25B 21/00 |
| 2006/0277939 | A1 | 12/2006 | Beks et al. | |
| 2007/0125120 | A1 * | 6/2007 | Marques | F25B 5/02 62/453 |
| 2007/0144181 | A1 * | 6/2007 | Kitanovski | F25B 21/00 62/3.1 |
| 2009/0314007 | A1 | 12/2009 | Wiest et al. | |
| 2010/0058775 | A1 * | 3/2010 | Kaji | F25B 21/00 62/3.1 |
| 2011/0215088 | A1 | 9/2011 | Muller et al. | |

FOREIGN PATENT DOCUMENTS

| | | |
|---|---|---|
| WO | WO2010086399 | 8/2010 |
| WO | WO2011059541 | 5/2011 |

OTHER PUBLICATIONS

Search Report in PCTEP2013062858, dated Jul. 26, 2013, WO.
Written Opinion in EP12174379, dated Nov. 2, 2012, EP.
Written Opinion in PCTEP2013062858, dated Jul. 26, 2013, WO.

* cited by examiner

DISPLAY CABINETS FOR FROZEN PRODUCTS

The present invention relates to display cabinets used for frozen products and more particularly ice cream. The present invention more particularly relates to display using magneto caloric technology.

BACKGROUND OF THE INVENTION

Refrigerating units for frozen foods display cabinets are known in the prior art and are normally relying on a gas compression/expansion cycle to generate the cooling effect inside a refrigerator or freezer located in a room temperature environment. They typically consist in a refrigerating circuit with a compressor, a condenser and an evaporator, the evaporator being intended to cool the inner space by evaporating a refrigerant.

More recently the use of magneto caloric technology has been suggested particularly because of its smaller environmental impact and its higher efficiency compared with conventional gas compression technology. The magneto caloric (MC) effect relies on the temperature change of a specific material (Magneto Caloric Material—MCM) when a changing magnetic field is applied to magnetise and demagnetise said MCM. In the later part of the $20^{th}$ century, Active Magnetic Refrigeration System was developed.

Because of the inherent pulsing nature of the circulation of the magneto caloric, the cooling of whatever volume which has to be cooled has been realized up to now via very complex 3 valve circulation systems which are for example described in WO2011/059541.

It has now been found that it is possible to avoid the above disadvantages by combining the Magneto Caloric Unit (MC Unit) with two heat exchangers operated with two independent heat exchanging fluid circulations.

DEFINITIONS

Roll Bonding

Roll bonding is a standard manufacturing process, particularly for the production of evaporators, wherein a tuning is an integral part of a sheet. In this process, a pattern is applied onto a first sheet, preferably a metal sheet, more preferably an aluminium sheet, and preferably using a stop-weld material, a second sheet is then placed face to face with the first sheet after what the resulting metal sandwich is heated and rolled. Hot rolling process completes the bond and subsequent cold rolling reduces the laminated structure to the right thickness. After rolling, the laminated sheet is annealed and, subsequently, a needle is inserted into the stop weld pattern and hydraulic pressure is applied, through the hollow needle to inflate the non welded pattern. Areas where the stop=weld compound has been applied become tubes which are integral part of the laminated sheet.

Magneto Caloric Unit

A Magneto Caloric Unit which can be used in the invention is for example described in US2011/0215088.

SUMMARY DESCRIPTION OF THE INVENTION

It is therefore the object of the invention to provide a display cabinet for frozen products comprising an MC unit having cold end with a primary cold heat exchanger and a hot end with a primary hot heat exchanger, and a cabinet suitable for containing frozen products the cabinet comprising a inner wall limiting a volume wherein frozen products can be stored, said cabinet having a secondary cold heat exchanger, wherein the secondary cold heat exchanger comprises circulating means for circulating a low freezing point liquid between said secondary cold heat exchanger and the primary cold heat exchanger Preferably the low freezing point liquid has a freezing point of between −30° C. and −40° C. The use of a low freezing point liquid instead of a gas under pressure allows for a simple cooling which does not require high pressure pipes or compressing systems and minimises the risks of leaks.

More preferably the low freezing point liquid is based on nontoxic mono propylene.

Preferably the cabinet is an open top display cabinet. By open top, it is meant a cabinet with an interior display space, limited by an inner wall, accessed through on open top which can preferably be closed by a lid that may be made, at least in part, of glass or other transparent material that permits potential customers to view the product displayed within the interior display space.

It has then been found that better cooling is obtained if the secondary cold heat exchanger has wall circulating means for circulating the low freezing point liquid close to the inner wall of the cabinet, the wall circulating means having at least one inlet and at least one outlet, said inlet being in the top half of the wall, said outlet being in the bottom half of the wall.

Preferably, the wall circulating means and the inner wall are roll bonded.

In a more preferred embodiment of the invention, the inlet opens into distribution means or manifold from which a multiplicity of flow passages extend, This allows for a reduction in the required pressure to enable the flow of the low freezing point liquid. The manifold is dimensioned and positioned such that substantially identical pressure drops are achieved in all the different flow passages.

Preferably also, the Temperature rise in the secondary cold heat Exchanger is small (between 2° C. and 5° C., preferably less than 3° C.) the connection between the MCU and the secondary cold heat exchanger must be kept minimum and well insulated.

Preferably also, the temperature rise in the secondary cold heat exchanger is such that the temperature remains below −18° C. so as to prevent any stored product reaching a temperature above −18° C. as this is particularly important for storing ice cream.

DETAILED DESCRIPTION OF THE INVENTION

Figure 2:
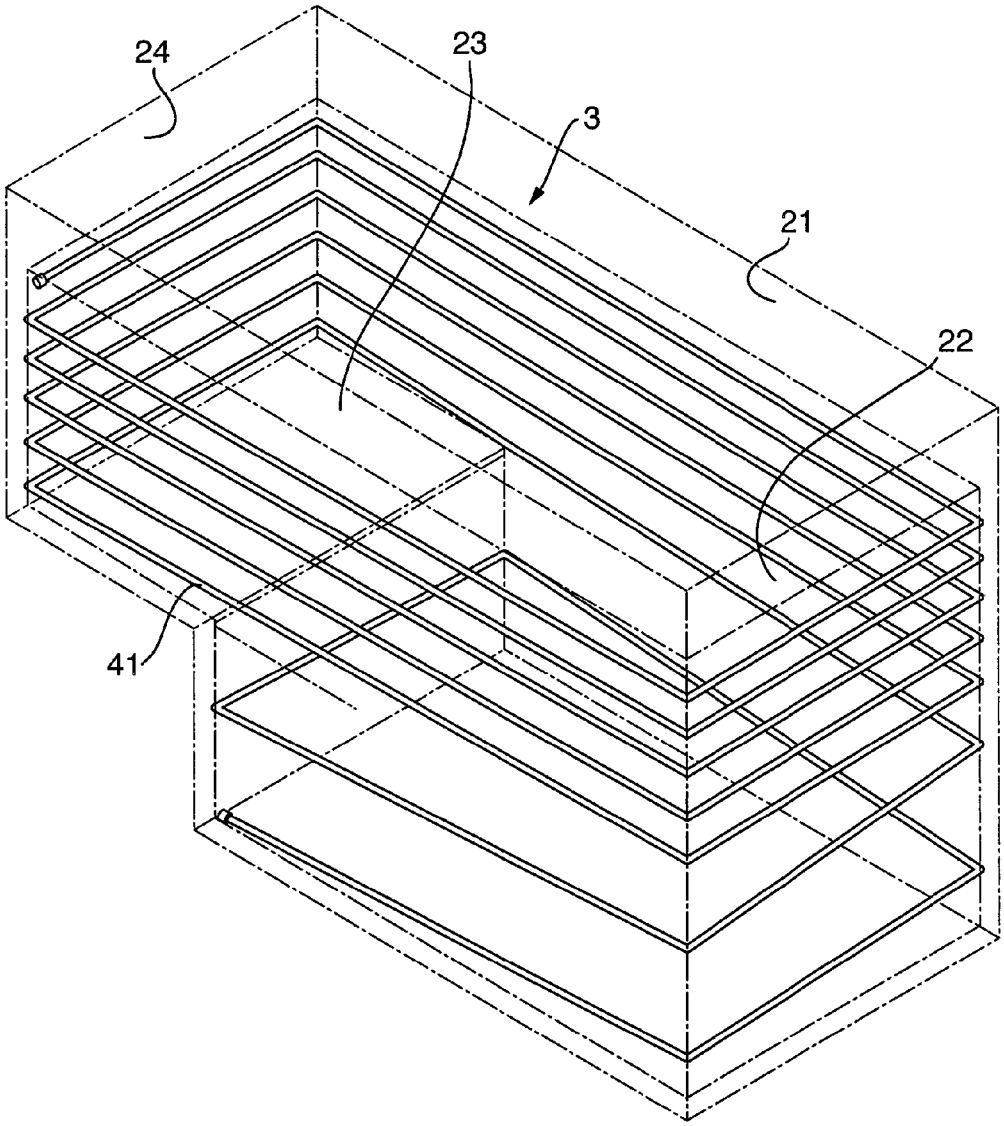
Figure 3:
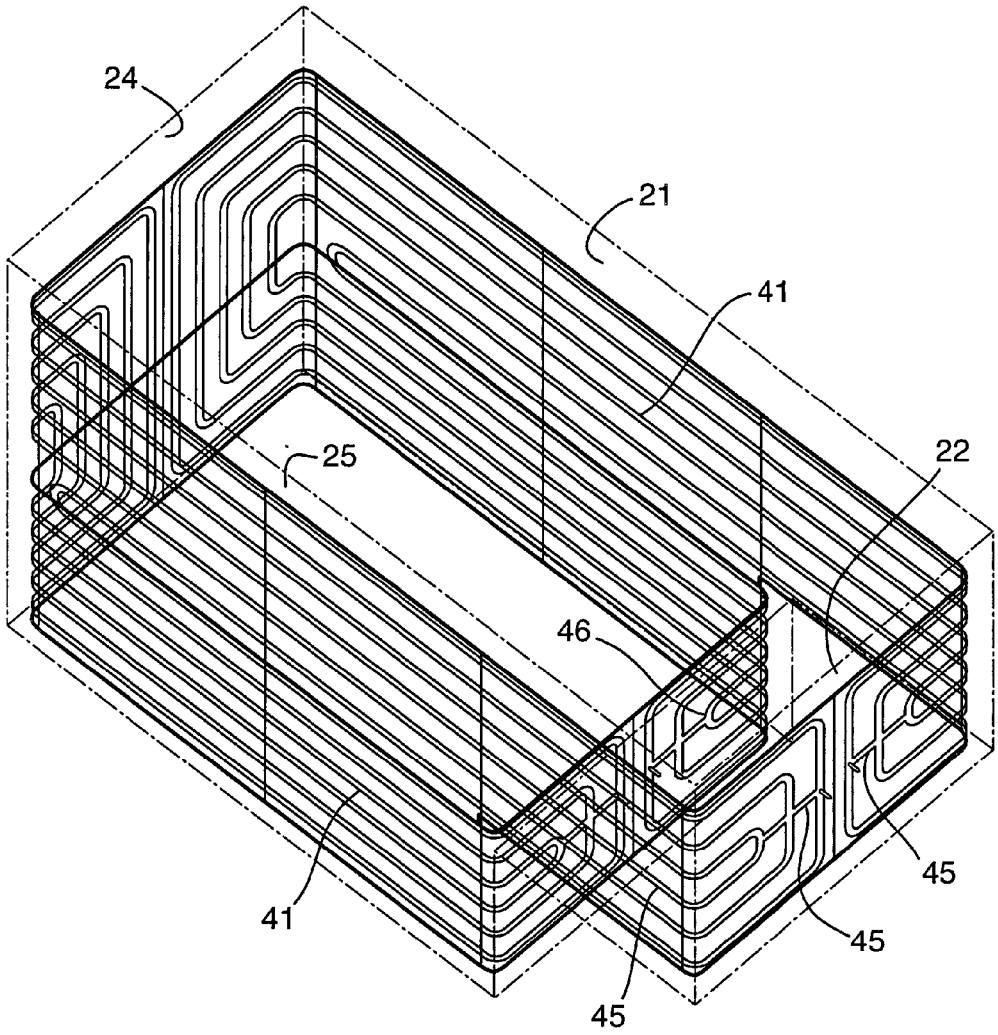

The present invention will be further described by reference to the following figures wherein:

FIG. 1 represents a schematic view of a display cabinet according to the invention, FIG. 2 represents a schematic view of a secondary cold exchanger according to the invention, FIG. 3 represents a schematic view of another secondary cold exchanger according to the invention.

As represented in FIG. 1, a display cabinet according to the invention comprises a Magneto Caloric Unit 1 with a cold end 11 and a hot end 12. The display cabinet also has a inner wall 2 limiting a volume 3 wherein frozen products can be stored, said cabinet having a secondary cold heat exchanger 4, wherein the secondary cold heat exchanger 4 comprises circulating means 5 for circulating a low freezing point liquid between said secondary cold heat exchanger 4 and a primary cold heat exchanger 6 located at the cold end 11 of the MCU 1.

When in operation, the cold end 11 of the MCU 1 is at a temperature of −23° C., the hot end 12 being at a temperature of 30° C.

As represented in FIG. 2, a display cabinet with a volume 3 limited by four vertical walls 21, 22, 23 and 24 has a secondary cold heat exchanger in the form of a coil 41 going from the top of a wall (21, 22, 23 or 24) to the bottom of a wall (21, 22, 23, or 24), the inlet being at the top and the outlet being at the bottom. The low freezing point liquid is Clogel 2503, a formulation based on nontoxic mono propylene, non flammable and unexploded.

(http://www.chimiphar.fr/index.php?option=com_content&task=view&id=16&Itemid=34)

At hot end 12, circulating means 120 allow for the circulation of a heat transfer fluid, which can be simply water, from a primary hot heat exchanger 7 to a secondary hot heat exchanger 121.

A display cabinet has described in FIG. 2, submitted to a heat load of 95 W, and through which a the low freezing point liquid flows at 17.5 g/s under a pressure drop of 1.6 bar had a wall temperature in its volume 3 of between −19° C. at the top and −22° C. at the bottom, the temperature, 5.5 centimeters beneath the glass top, being −16° C., the temperature in the centre of the volume being around −16° C.

As represented in FIG. 3, a display cabinet with a volume 3 limited by four vertical walls 21, 22, 23 and 24 has its secondary cold heat exchanger made of two sub-circuits 42 and 43. The volume 3 being symmetrical w.r.t to a vertical symmetry plane the sub circuit 42 is substantially a mirror image of sub circuit 43 with regard to the symmetry plane. The inlet of each sub circuit (42 or 43) is located in the top half of a wall (21, 22, 23 or 24), the outlet of each sub circuit being located in the bottom half. Each inlet is divided into a multiplicity of passages 44 by a manifold 45. The passages 44 of each sub circuit (42 or 43) connect back at the bottom of the volume 3 through a manifold 46.

A display cabinet as described in FIG. 3 submitted to a heat load of 95 W, and through which a the low freezing point liquid flows at 26 g/s under a pressure drop of 0.07 bar had a wall temperature in its volume 3 of between −19° C. at the top and −22° C. at the bottom, the temperature, 5.5 centimeters beneath the glass top, being −18° C., the temperature in the centre of the volume being around −18° C.

This shows that an embodiment as described in FIG. 3 achieve a better cooling than an embodiment according to FIG. 2 while consuming less energy (smaller pressure drop).

The invention claimed is:

1. A display cabinet for frozen products comprising:

a Magneto Caloric unit having cold end with a primary cold heat exchanger and a hot end with a primary hot heat exchanger; and a cabinet suitable for containing frozen products, the cabinet comprising an inner wall limiting a volume configured for the storage of frozen products, the cabinet having a secondary cold heat exchanger, wherein the secondary cold heat exchanger comprises an exchanger circulator configured for circulating a low freezing point liquid between the secondary cold heat exchanger and the primary cold heat exchanger;

wherein the secondary cold heat exchanger has a wall circulator for circulating the low freezing point liquid close to the inner wall of the cabinet, the wall circulator having at least one inlet and at least one outlet, the inlet being in a top half of the wall, the outlet being in a bottom half of the wall;

wherein the inlet opens into a manifold from which a multiplicity of flow passages extend; and wherein the low freezing point liquid is isolated from the primary hot heat exchanger.

2. The display cabinet according to claim 1, wherein the low freezing point liquid has a freezing point of between −30° C. and −40° C.

3. The display cabinet according to claim 1, wherein, in operation, a temperature of the low freezing point liquid in the secondary cold heat exchanger remains below −18° C. and rise between 2° C. and 5° C.

4. The display cabinet according to claim 1, wherein the cabinet is an open top display cabinet.

5. The display cabinet according to claim 1, wherein the wall circulator and the inner wall are roll bonded.

6. The display cabinet according to claim 1, wherein the manifold is dimensioned and positioned such that substantially identical pressure drops are achieved in all the different flow passages.

* * * * *